United States Patent [19]

Horvat et al.

[11] Patent Number: 4,487,137

[45] Date of Patent: Dec. 11, 1984

[54] AUXILIARY EXHAUST SYSTEM

[76] Inventors: George T. Horvat, 1319 S. 102nd St., West Allis, Wis. 53214; Stephen D. Horvat, 211 N. 36th St., Milwaukee, Wis. 53208

[21] Appl. No.: 459,816

[22] Filed: Jan. 21, 1983

[51] Int. Cl.[3] ..... F23L 17/16; F23N 3/00

[52] U.S. Cl. ..... 110/160; 110/162; 110/163; 126/80; 126/293; 126/312; 169/54; 236/45; 236/96; 431/20

[58] Field of Search ..... 110/160, 162, 163, 184; 98/78; 126/80, 293, 312; 169/54; 236/45, 1 G, 10, 11, 95, 96; 431/20

[56] References Cited

U.S. PATENT DOCUMENTS

| | | | |
|---|---|---|---|
| 2,014,187 | 9/1935 | Neff | 110/160 |
| 2,497,944 | 2/1950 | Jendresen | 110/160 |
| 4,335,704 | 6/1982 | Wingstrom et al. | 126/293 |
| 4,341,267 | 7/1982 | Lagasse | 169/54 |
| 4,341,344 | 7/1982 | Russell | 110/163 |

*Primary Examiner*—Edward G. Favors
*Assistant Examiner*—Steven E. Warner
*Attorney, Agent, or Firm*—Andrus, Sceales, Starke & Sawall

[57] ABSTRACT

An auxiliary exhaust system for use with a flue includes a conduit communicating at one end with an opening formed in the flue wall and a blower operable to introduce auxiliary air into the flue through the conduit. The conduit is angled so that the auxiliary air enters the flue with a velocity component extending in the downstream direction of the flow of the products of combustion to aid in venting the combustion unit. A damper located within the conduit operates an on-off switch in a blower control circuit which starts and stops the blower when the damper is opened and closed, respectively. The blower control circuit also includes an automatic combustion control which is responsive to flue temperature to increase the speed of the blower whenever the flue temperature is below a predetermined value and to decrease the blower speed whenever the flue temperature is above a predetermined value. The blower includes an access port which enables a fire extinguishing chemical to be introduced into the flue.

6 Claims, 4 Drawing Figures

AUXILIARY EXHAUST SYSTEM

BACKGROUND OF THE INVENTION

The present invention relates to heating devices such as wood and coal burning stoves, incinerators, and the like, and more particularly to an auxiliary exhaust system for use with a flue that aids venting and provides a combustion control for such heating units.

Heating units such as coal or wood burning stoves have become popular for use in residential homes due to the ever increasing cost of electricity and natural gas. The use of such heating units, however, also poses several objectionable problems. One such problem is the escape of smoke or carbon monoxide gas from the heating unit into the home when the feed door of the unit is opened to refuel the fire. Another problem is the potential fire hazard which may occur due to the buildup of creosote in the flue and chimney when burning wood or the buildup of soot when burning coal.

Another problem associated with such residential heating units is draft control. Coal and wood burning stoves require an adequate supply of air in order to promote the most efficient combustion of the fuel. If the supply of air is insufficient, the stove is burning inefficiently due to the passage of unburned gases into the flue. If the supply of air is in excess of that required, the stove is burning inefficiently due to the absorption of heat by the excess air passing into the flue. In the past, air for combustion has generally been provided by the natural draft occurring as the hot gases of combustion flow from the combustion chamber through the flue to the chimney which draws air through vents located in the stove. The amount of air supplied through natural draft, however, is subject to wide variations due to weather and atmospheric conditions. In addition, the flue may be improperly installed resulting in the occurrence of poor or inadequate venting. Thus, natural draft will not always provide the ideal air supply to promote efficient combustion.

SUMMARY OF THE INVENTION

An auxiliary exhaust system for use with coal or wood burning stoves, incinerators, or the like provides ideal air supply and draft conditions to promote efficient fuel combustion, and to prevent the escape of smoke and other by-products of combustion.

The auxiliary exhaust system includes conduit means communicating at one end with one opening formed in a flue wall, and blower means having an air inlet located exteriorly of the flue and an air outlet communicating with the other end of the conduit means. The blower means is operable to introduce auxiliary air into the flue with a velocity component extending in the downstream direction of the flow of the products of combustion. The inrushing air and pressure generated thereby creates a positive downstream directional flow for the air, smoke and by-products of combustion within the flue. The blower means will thus effectively bring about a lower pressure within the firebox of the combustion unit than is in the flue which will positively control the direction of air flow within the firebox itself toward the flue and away from the door of the unit. This insures that smoke, carbon monoxide and other objectionable by-products of combustion will be directed into the flue and will not escape from the combustion unit when its feed door is occasionally opened to refuel the fire.

Damper means is located within the conduit of the auxiliary exhaust system and is operable through an on-off switch means of a blower control circuit to start the blower means when the damper means is closed. The on-off switch means provides a positive control for insuring that the blower means is running when the damper is opened and stopped when the damper is closed.

The blower control circuit also includes manual switch means for varying the speed of the blower means. Such manual means may include a step-type rheostat which enables the blower means to run at high speed for maximum draft, as for example when starting the fire or when opening the feed door to refuel the fire in the combustion unit. The step-type rheostat also provides low speed operation for continuous draft conditions which increases the combustion efficiency where poor draft conditions exist.

The auxiliary exhaust system also functions as a combustion control device. For this purpose, the blower control circuit includes automatic means responsive to flue temperature for increasing or decreasing the speed of the blower means depending upon whether the flue temperature is above or below a predetermined value. The automatic means includes heat sensing means in the form of a bi-metallic sensor for sensing the flue temperature, and regulating means in the form of a smooth-type rheostat which is coupled to the bi-metallic sensor for varying the speed of the blower means. Thus, since an efficient wood burner maintains a flue temperature of around 300° F. this automatic means in the blower control circuit provides a combustion control device which effectively controls the amount of oxygen in the firebox that is necessary for efficient combustion.

The present invention thus provides an auxiliary exhaust system that provides ideal air supply and draft conditions for controlling combustion and for preventing the escape of objectionable products of combustion.

BRIEF DESCRIPTION OF THE DRAWINGS

The drawings show the best mode presently contemplated of carrying out the invention.

In the drawings.

DESCRIPTION OF THE PREFERRED EMBODIMENT

Figure 1:
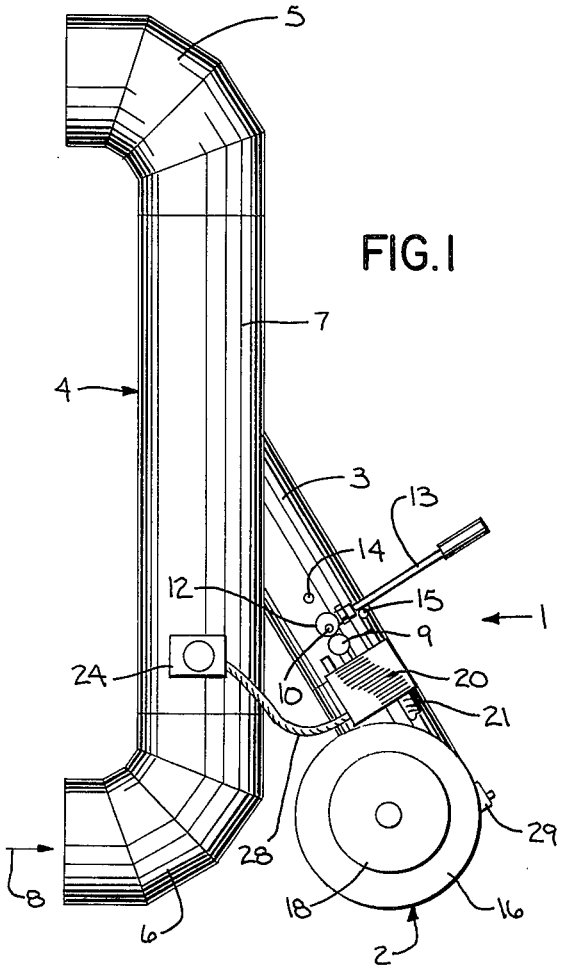
FIG. 1 is a side view in elevation of a flue pipe incorporating an auxiliary exhaust system constructed in accordacne with the principles of the present invention.
Figure 2:
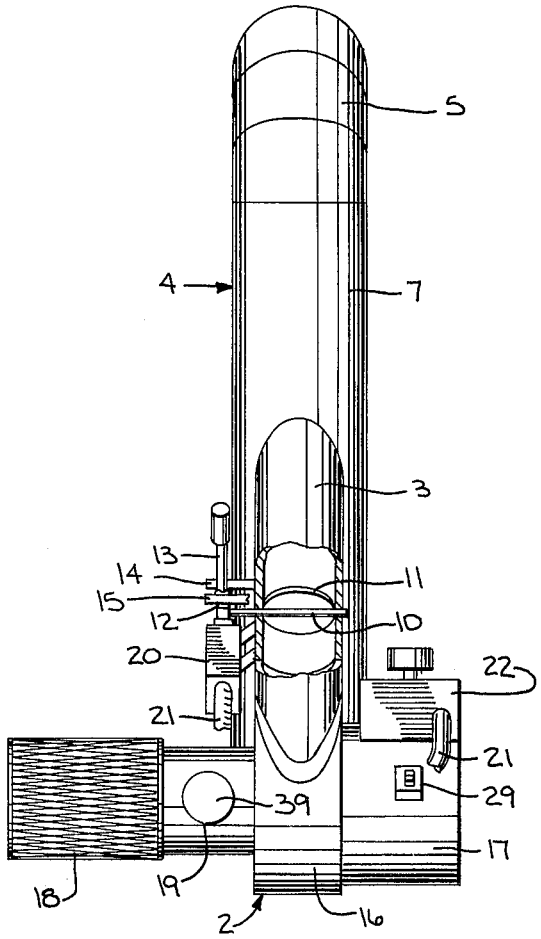
FIG. 2 is a rear view in elevation with parts broken away of the device of FIG. 1.

Referring now to the drawings, FIGS. 1 and 2 show an auxiliary exhaust system constituting a preferred embodiment of the present invention. The auxiliary exhaust system, generally designated by the numeral 1, is adapted for use with combustion units such as coal or wood burning stoves for residential heating, incinerators, and the like. Specifically, the auxiliary exhaust system 1 is adapted for use with a flue that vents the by-products of combustion such as smoke, carbon monoxide and the like.

As shown in FIGS. 1 and 2, the auxiliary exhaust system 1 includes a blower 2 having its outlet communicating with a conduit 3 which in turn communicates with a flue 4. Flue 4, as shown, includes an upper elbow 5, a lower elbow 6 and an intermediate longitudinal portion 7 interconnecting elbows 5 and 6. Upper elbow 5 leads to a chimney (not shown) while lower elbow 6 leads to the firebox of the combustion unit (not shown). Thus, the flow of the products of combustion within flue 4 is in the direction of arrow 8 resulting in lower elbow 6 being upstream from upper elbow 5. Intermediate portion 7 of flue 4 may be separate from conduit 3 or may be integrally formed in one piece therewith, as shown in FIGS. 1 and 2.

Conduit 3 communicates at one end with an opening formed in portion 7 of the flue wall and is attached thereto by welding or other suitable means that provides an air tight joint. As seen best in FIG. 1, conduit 3 is positioned such that its longitudinal axis is disposed outwardly and in an upstream direction with respect to the longitudinal axis of intermediate portion 7 of flue 4 to define an acute angle of entry for the air from blower 2. This angle of entry is preferably about 60°. As shown, the diameter of conduit 3 is less than the diameter of flue 4 which helps to create a positive direction of flow for the currents within flue 4. The diameter of conduit 3, however, may vary depending upon the capacity of the blower 2 being utilized.

A damper assembly is provided within conduit 3 to prevent the escape of smoke or other gases through blower 2 when blower 2 is not in operation. The damper assembly includes a shaft 10 extending across the diameter of conduit 3 and journalled for rotation in the side walls of conduit 3. A circular flat plate 11 is attached to shaft 10 for rotation therewith having a diameter substantially corresponding to the inner diameter of conduit 3. Plate 11 could also be dimensioned to substantially conform to the interior configuration of a conduit which may be other than circular in shape. Thus, when the shaft 10 is rotated plate 11 moves between a closed position wherein it blocks off conduit 3 and an open position wherein it permits passage of air from blower 2 through conduit 3 into flue 4. A cam 12 is mounted on the end of shaft 10 exteriorly of conduit 3, and a lever 13 is connected to cam 12. Lever 13 extends normal to the direction of the axis of shaft 10 and is utilized to rotate plate 11 between its open and closed positions. Thus, as seen best in FIG. 1 when lever 13 is normal to the longitudinal axis of conduit 3 plate 11 is closed and when moved to a position which is parallel to the axis of conduit 3 plate 11 is open. A pair of stops 14 and 15 are mounted on conduit 3 for engaging lever 13 to assist in holding plate 11 in its open or closed positions, respectively.

Blower 2 is provided at the lower end of conduit 3 for producing a current of auxiliary air that passes through conduit 3 into flue 4. Blower 2 has its air inlet located exteriorly of flue 4 and its air outlet communicating with the lower end of conduit 3 in a fluid tight connection. Blower 2 is operable to introduce auxiliary air into flue 4 through conduit 3 with a velocity component extending in the downstream direction of the flow of the products of combustion within flue 4. Blower 2 includes a main body 16 which houses a fan (not shown) that is rotated by a variable speed electric motor 17 to produce the current of auxiliary air. Air is drawn through a filter 18 located at the inlet of blower 2. An access port 19 is located between filter 18 and body 16 which functions as a means for connecting a fire extinguisher to blower 2, as will hereinafter be more fully described. Blower 2 may be of any conventional design that produces a current of air, and thus need not necessarily be of the specific type shown in FIG. 2 and described herein.

Figure 4:
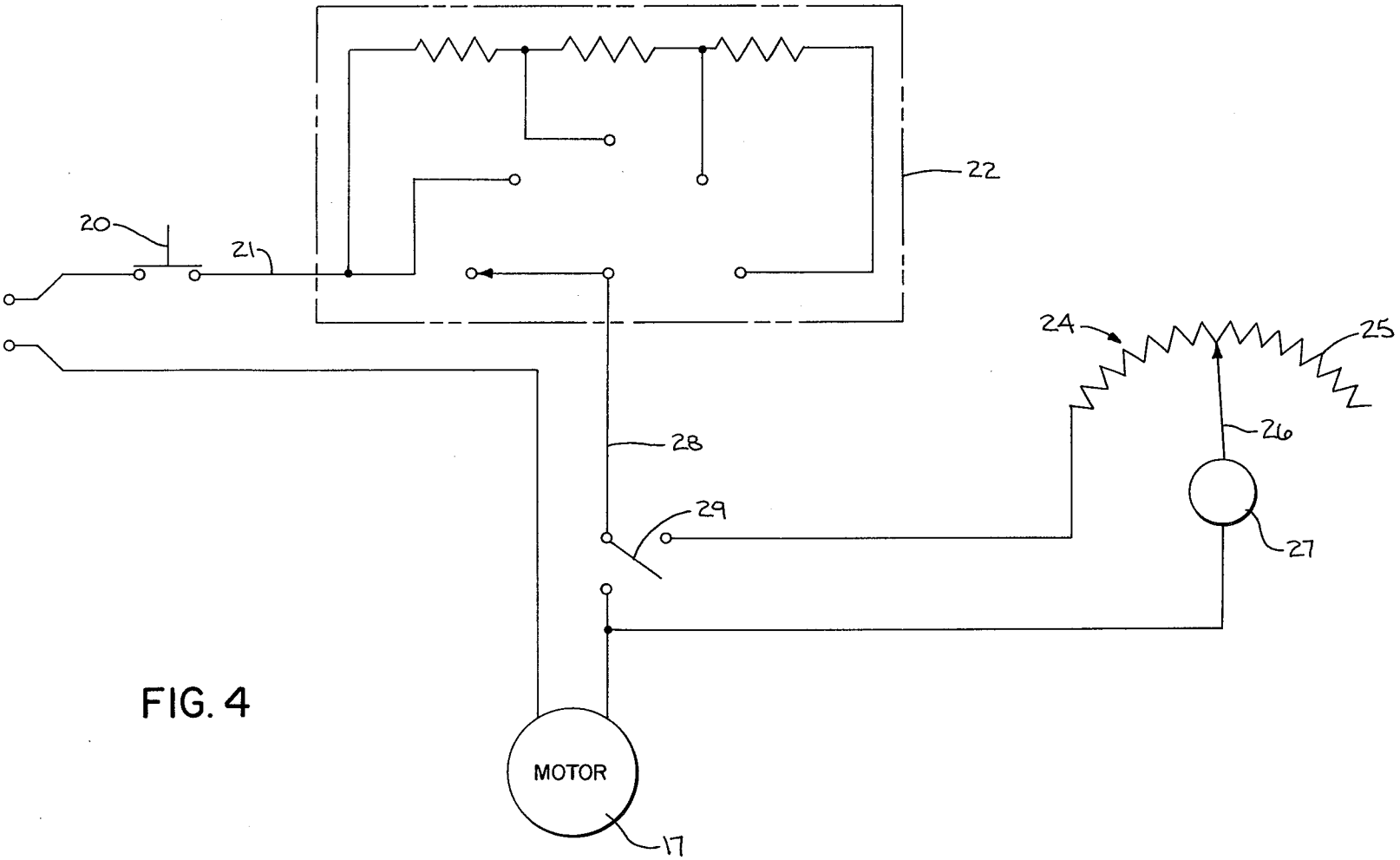
FIG. 4 is a schematic electrical diagram illustrating the blower control circuit.

FIG. 4 is a schematic electrical diagram illustrating a blower control circuit for blower 2. The blower control circuit includes an on-off switch means in the form of a normally open push button switch 20 which, as shown in FIG. 1, is mounted at the lower end of conduit 3. Switch 20 is operable in response to the opening and closing of the damper assembly to start and stop blower 2, respectively. In order to perform this start-stop function it is positioned so that its contact 9 is engageable by the cam 12 on shaft 10. Thus, when plate 11 is in its closed position contact 9 of which 20 is in its normally opened position so that blower 2 is stopped or inoperable, and when plate 11 is moved by lever 13 to its opened position cam 12 moves contact 9 of switch 20 so that electrical current is applied to start blower 2. As shown best in FIG. 2, circuit connections 21 connect switch 20 to a step-type rheostat 22 which in turn is connected by circuit connections to a 110 volt source of electricity, such as that commonly found in residential houses. Rheostat 22 functions as a manual means for varying the speed of blower 2 by regulating the strength of electric current applied thereto. Rheostat 22 is shown schematically in FIG. 4 as having four distinct positions depending upon the desired resistance to be incorporated in the circuit. However, any conventional step-type rheostat or equivalent control device may be incorporated in the blower control circuit. As shown best in FIG. 2, rhoestat 22 is mounted on the housing for motor 17 of blower 2 although it may be mounted in any convenient position. In operation, after switch 20 is closed rheostat 22 may be utilized to control the speed of blower 2 so that blower 2 can be run continuously at various speeds. For example, blower 2 may be run at a relatively low speed to maintain an effective burning of the fuel and a positive directional flow of the exhaust by-products. Blower 2 may thus also be run at a higher speed such as when poor draft conditions exist or when opening the refueling door of the firebox to reduce the tendency of objectionable by-products to escape through the open door.

The blower control circuit also includes a means for operating blower 2 automatically as a combustion control device. The automatic means is responsive to the temperature of flue 4 and functions to increase the speed of blower 2 whenever the flue temperature is below a predetermined value and to decrease the speed of blower 2 whenever the flue temperature is above the predetermined value. For example, an efficient wood burning stove maintains a flue temperature of around 300° F. and thus if the flue temperature would drop significantly below 300° F. the speed of blower 2 would be increased to increase the amount of oxygen within the firebox of the combustion unit. In contrast, if the flue temperature increases significantly beyond 300° F. the automatic control would decrease the speed of blower 2 and thus decrease the amount of oxygen within the firebox so that combustion is effectively reduced.

The automatic means for controlling or varying the speed of blower 2 includes a smooth-type rheostat 24 having a variable resistor 25 and a contact 26 movable along resistor 25, and a bi-metallic thermocouple 27 coupled to contact 26 for moving contact 26 in response to flue temperature. Thermocouple 27 functions as a heat sensing means for sensing the flue temperature while rheostat 24 functions as a regulating means for varying the speed of blower 2 in response to the temperature sensed by thermocouple 27. Since thermocouple 27 is coupled to contact 26, thermocouple 27 will move contact 26 to increase the resistance when the flue temperature is above the predetermined value which correspondingly decreases the speed of blower 2, and decreases the resistance when the flue temperature is below the predetermined value which correpondingly increases the speed of blower 2. As shown best in FIG. 1, rheostat 24 and thermocouple 27 is mounted on flue 4 at a position which is upstream from the entrance of the auxiliary air, and is connected by circuit connections 28 to switch 20.

As shown in FIG. 4, the blower control circuit also includes a selector switch 29 which is selectively movable between a first position wherein rheostat 24 and thermocouple 27 is operable, and a second position wherein rheostat 24 and thermocouple 27 is inoperable. In the second position of switch 29 only rheostat 22 is operational to vary the speed of blower 2. Thus, in order to operate rheostat 24 and thermocouple 27 selector switch 29 must be in its first position and rheostat 22 must be in one of its on positions. In addition, push button switch 20 must be closed.

Figure 3:
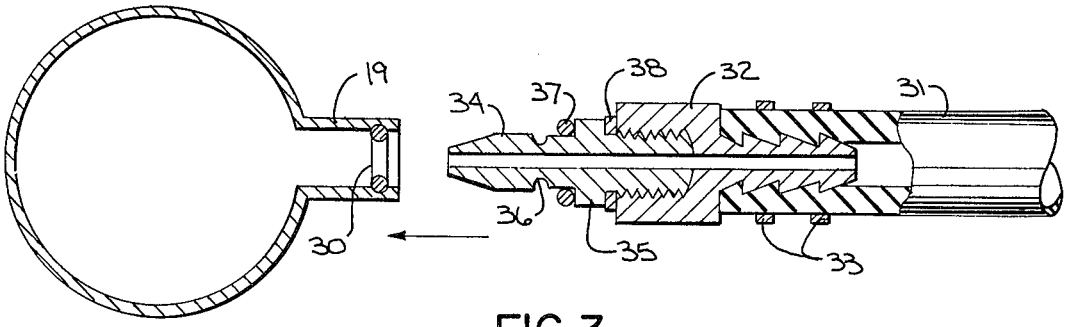
FIG. 3 is a detailed cross sectional view of a fire extinguisher access port and hose connection therefor.

Referring now to FIG. 3, access port 19 in blower 2 functions as a connection for a fire extinguisher hose. As shown, port 19 includes a snap ring 30 located therein for receiving and holding the end of a fire extinguisher hose 31. The end of hose 31 includes a hose connector 32 having its shank portion received within hose 31 and clamped in place by a pair of hose clamps 33. A nozzle 34 is threadedly engaged within connector 32 that includes a flange 35 and an annular groove 36 located between flange 35 and the tip of nozzle 34. An O-ring gasket 37 is positioned on nozzle 34 between groove 36 and flange 35, and a flat gasket 38 is positioned between flange 35 and the end of connector 32.

In operation, access port 19 will normally be closed by a plug 39 which provides an air tight seal. However, when plug 39 is removed nozzle 34 may be inserted within port 19 until snap ring 30 is engaged within groove 36. In this position, gasket 37 engages snugly against the outer surface of port 19 to provide a fluid tight seal. The fire extinguisher may then be discharged into port 19. However, prior to insertion of nozzle 34 blower 2 should be set to run at its maximum speed so that when the fire extinguishing chemical, preferably an oxygen supressing dry chemical such as that available under the trademark, A-B-C, is discharged into blower 2, blower 2 will transfer the chemical into flue 4 via conduit 3 and up into the chimney to thereby extinguish any fire that may have occurred.

An auxiliary exhaust system for use with units such as coal or wood burning stoves has been illustrated and described. The system provides a combustion control device designed to provide ideal air supply and draft conditions to promote efficient fuel combustion. The system also prevents the escape of smoke and other objectionable products of combustion during refueling of such a unit and includes a means for connecting a fire extinguisher to extinguish any fire which may occur in the flue or chimney.

Various modes of carrying out the invention are contemplated as being within the scope of the following claims particularly pointing out and distinctly claiming the subject matter which is regarded as the invention.

I claim:

1. An auxiliary exhaust system for use with a flue having a flue wall that defines a passageway for venting products of combustion such as smoke and the like, comprising:

conduit means having first and second ends, said conduit means projecting from said flue and communicating at said first end with an opening formed in the flue wall;

blower means having an air inlet located exteriorly of said flue and an air outlet communicating with said second end of said conduit means, said blower means operable to introduce auxiliary air into said flue with a velocity component extending in the downstream direction of the products of combustion within said flue;

damper means located within said conduit means and movable between a closed position and an open position; said damper means including a rotatable shaft journaled in the walls of the conduit means, a plate mounted on said plate and dimensioned to substantially conform to the interior configuration of said conduit means, cam means mounted on said shaft and lever means connected to said cam means for rotating said cam means and shaft, and blower control means including a normally open push button switch engageable by said cam means, and circuit connections connecting said blower means to a source of electric current through said push button switch so that when said damper means is in its open position said push button switch is engaged by said cam means and applies electric current to start said blower means.

2. An auxiliary exhaust system for use with a flue having a flue wall that defines a passageway for venting products of combustion such as smoke and the like, comprising:

conduit means having first and second ends, said conduit means projecting from said flue and communicating at said first end with an opening formed in the flue wall;

blower means having an air inlet located exteriorly of said flue and an air outlet communicating with said second end of said conduit means, said blower means operable to introduce auxiliary air into said flue with a velocity component extending in the downstream direction of the products of combustion within said flue, said blower means includes fan means and a variable speed electric motor coupled to said fan means for rotating said fan means; and blower control means including automatic means responsive to flue temperature for increasing the speed of the blower means whenever the flue temperature is below a predetermined value and for decreasing the speed of the blower means whenever the flue temperature is above the predetermined value, said automatic means includes heat sensing means for sensing the flue temperature, and regulating means coupled to said heat sensing means for varying the speed of the blower means in response to the temperature sensed by said sensing means, said regulating means regulates the strength of an electric current applied to said motor and includes a smooth-type rheostat having a variable resistor and a contact movable along said resistor, and said heat sensing means includes bi-metallic means coupled to said contact for moving said contact to increase the resistance of said rheostat when the flue temperature is above the predetermined value and for moving said contact to decrease the resistance of said rheostat when the flue temperature is below the predetermined value.

3. The auxiliary exhaust system of claim 2, further including connector means for connecting a first extinguisher to said blower means so that said blower means is further operable to introduce a fire extinguishing chemical along the auxiliary air into said flue.

4. The auxiliary exhaust system of claim 2, wherein said blower control means further includes manual means for varying the speed of the blower means by regulating the strength of an electric current applied thereto; and selector switch means selectively movable between a first position wherein said automatic means is operable and a second position wherein said automatic means is inoperable.

5. The auxiliary exhaust system of claim 4, wherein said manual means includes a step-type rheostat.

6. The auxiliary exhaust system of claim 4, further including damper means located within said conduit means and movable between a closed position and an open position; and said blower control means further includes on-off switch means operable by the damper means for stopping the blower means when the damper means is closed and starting the blower means when the damper means is open.

* * * * *